US005869180A

United States Patent [19]

Büdenbender et al.

[11] Patent Number: 5,869,180

[45] Date of Patent: Feb. 9, 1999

[54] MELT-SPUN ABRASION-RESISTANT MONOFILAMENTS

[76] Inventors: Jürgen Büdenbender, Am Weissen Kreuz 11, 41539 Dormagen; Eckhard Gärtner, Ulmenallee 17, 41540 Dormagen, both of Germany

[21] Appl. No.: 774,828

[22] Filed: Dec. 27, 1996

[30] Foreign Application Priority Data

Jan. 4, 1996 [DE] Germany ..... 19 600 162.5

[51] Int. Cl.[6] ..... D02G 3/00; D32B 7/00; B26D 1/00

[52] U.S. Cl. ..... 428/373; 428/364; 428/374; 428/395; 442/59; 442/311; 442/329; 442/361; 162/900; 83/651.1

[58] Field of Search ..... 428/364, 373, 428/374, 395; 442/59, 311, 329, 361; 162/900; 83/651.1

[56] References Cited

U.S. PATENT DOCUMENTS

| | | | |
|---|---|---|---|
| 5,082,899 | 1/1992 | Sawyer et al. | 428/373 |
| 5,126,199 | 6/1992 | Sawyer et al. | 428/373 |
| 5,169,711 | 12/1992 | Bhatt et al. . | |
| 5,185,199 | 2/1993 | Sawyer et al. | 428/374 |
| 5,372,885 | 12/1994 | Tabor et al. | 428/395 |

FOREIGN PATENT DOCUMENTS

| | | |
|---|---|---|
| 0070709 | 1/1983 | European Pat. Off. . |
| 0287297 | 10/1988 | European Pat. Off. . |
| 0372769 | 6/1990 | European Pat. Off. . |
| 0463512 | 1/1992 | European Pat. Off. . |
| 06-116812 | 4/1994 | Japan . |
| 06-294010 | 10/1994 | Japan . |
| WO 93/01325 | 1/1993 | WIPO . |

OTHER PUBLICATIONS

English–language Abstract of EP –0 463 512 (A), Jan. 2, 1992.

Extrusion von Monofilen; Handbuch der Kunststoffechnik II, C. Hauser Publishers, Munich 1986, pp. 295–319.

*Primary Examiner*—A. A. Turner
*Assistant Examiner*—J. M. Gray

[57] ABSTRACT

The invention relates to melt-spun monofilaments of polyamide, polyester or polypropylene as filament-forming polymers with improved abrasion resistance and their use for producing technical materials or use as wire.

11 Claims, No Drawings

MELT-SPUN ABRASION-RESISTANT MONOFILAMENTS

The invention relates to melt-spun monofilaments of polyamide, polyester or polypropylene as filament-forming polymers with improved abrasion resistance and their use for producing technical textile materials or use as wire.

BACKGROUND OF THE INVENTION

The processes for producing monofilaments from thermoplastic polymers are known in principle and are described, for example, in Handbuch der Kunststofftechnik II, C Hauser Publishers, Munich 1986, pp. 295–319.

It is further known that the notched bar impact strength of moulded bodies of thermoplastic polymers can be improved by the addition of polyethylene/polypropylene rubber. In known manner the polymer mixtures of thermoplastic polymers and modified polyethylene/polypropylene rubber are granulated and compounded on double-shaft extruders and processed by injection moulding.

To date, few suitable polymer mixtures have become known for the manufacture of monofilaments for technical purposes, such as further processing into press felts for the paper industry, which must in particular have high mechanical strength with respect to abrasion. From US patent specification 5 169 711 it is known that the abrasion resistance of monofilaments of polyethylene terephthalate (PET) can be increased by the addition of thermoplastic polyurethane (TPU).

Monofilaments of polymer mixtures of polyamide, polyphenylene ether and a functionalized elastomer are also known for the manufacture of press felts (see international patent application WO 93/1325 for example).

The abrasion resistance of the monofilaments and hence of the technical fabrics that can be produced from them is improved by the above-mentioned known raw material modifications to only an inadequate extent, and in addition the strength of the monofilaments is reduced.

SUMMARY OF THE INVENTION

The object of the invention is to improve the abrasion resistance and the alternating bending strength of melt-spun monofilaments and their processability to technical fabrics or wire and thereby significantly to prolong the service life of technical fabrics for example.

According to the invention this object is achieved by melt-spun monofilaments for the manufacture of technical wire or technical textile materials, characterized in that they contain a) 99 to 70 wt. %, preferably from 80 to 95 wt. %, of nylon, polyester or polypropylene as filament-forming polymer, b) from 30 to 1 wt. %, preferably from 5 to 20 wt. %, of a maleic anhydride modified polyethylene/polypropylene rubber and additionally c) up to 3 wt. %, preferably from 0.01 to 3 wt. %, related to the sum of a)+b), of ageing stabilizers, e.g. sterically hindered phenols (SHP), carbodi-imides or aromatic amines, copper salts, particularly those of monovalent copper.

The monofilaments according to the invention are distinguished by a permanently improved abrasion resistance, improved resistance to alternating bending stress and reduced thermo-shrinkage forces.

The invention also provides the use of the monofilaments according to the invention for producing technical textiles, such as fabrics and felts for industry, e.g. grading fabrics, screen printing fabrics, mould screen fabrics and press felts for paper and cellulose fibre manufacture.

The service life of the technical textiles, particularly the mould screen fabrics and press felts for paper and cellulose fibre manufacture, is prolonged by the use of monofilaments according to the invention compared with known monofilaments.

DETAILED DESCRIPTION OF THE INVENTION

The monofilaments according to the invention are produced according to per se known melt extrusion processes. The raw materials are used either as granular mixture and/or as granular/powder mixture or as compounded granules. Attention should be paid to a homogeneous thorough mixing of the components in the melt and hence ultimately in the monofilaments. This is achieved by means of commercially available dynamic mixers after extrusion.

The objective was to increase the notched bar impact strength of the polymers and the transverse stability of the monofilaments obtained from the polymers.

In the monofilaments according to the invention an improvement of the abrasion resistance with an increasing content of maleic anhydride modified polyethylene/polypropylene rubber was surprisingly discovered in wear tests.

Furthermore, a reduction of the thermo-shrinkage forces was unexpectedly achieved with only a small addition of maleic anhydride modified polyethylene/polypropylene rubber, which has a positive effect on the dimensional stability of the fabrics produced from the monofilaments in the thermo-fixing of the fabric.

The invention further provides the use of the monofilaments according to the invention for producing technical textile materials or technical wires, particularly lawnmower wire. The monofilaments according to the invention are preferably used in so-called technical textiles such as fabrics and felts for industry, e.g. grading fabrics, screen printing fabrics, mould screen fabrics and press felts for paper and cellulose fibre manufacture.

Preferred filament-forming thermoplastic polymer for producing the monofilaments is nylon, particularly nylon (PA) 6, 6.6, 6.10, 6.12, 11 and 12, mixtures of the nylon or copolymers thereof. Preferred polyesters are polyethylene terephthalate (PET) or polybutylene terephthalate (PBT).

As additional additives up to 15 wt. %, related to the sum of the components a), b) and c), of plasticizers, e.g. caprolactam for nylon, phenols, arylsulphonyl amides or phthalic acid esters, pigments, e.g. $TiO_2$, carbon black, dyes, internal lubricants e.g. alkaline earth stearates particularly of Ca or Mg, waxes to increase transparency, such as those based on fatty acid amides, may be added to the mixture according to the invention.

EXAMPLES

Examples 1 to 5 illustrate monofilaments according to the invention, Example 6 a comparative example. A nylon 6 with a relative solution viscosity of $\eta_{rel}$=4.0 (measured in m-cresol at 25° C.) was used as filament-forming polymer (component A). A medium-viscosity semi-crystalline maleic anhydride modified PE/PP rubber was used as modified rubber (component B).

In the examples a product made by EXXON Chemical GmbH with the trade name EXXELOR VA 1803 was used as the PE/PP rubber. The chemical formula is quoted as:

$$H(C_2H_4)X(CH_2CH—CH_3)Y(O{=}COC{=}OCH{=}CH)_ZH$$

with the indices X=0.5–0.6, Y=0.5–0.4, Z=0.002. The molecular weight is quoted at 20,000 to 60,000.

Component C) is a commercially available ageing stabilizer IRGANOX 1098 from Ciba Geigy, a sterically hindered phenol of formula (I)

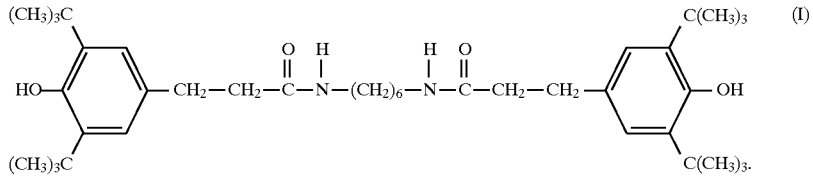

(I)

N,N'-hexamethylene-bis-(3,5-di-tert.-butyl-4-hydroxyhydrocinnamic amide).

The concentrations of component A) were varied between 98.25 wt. % and 84.5 wt. %, and of component B) between 1.25 wt. % and 15 wt. %. The concentration of component C) was left constant at 0.5 wt. %.

Components A), B) and C) were degassed as granules and/or granule/powder mixture according to the desired concentration ratio on a single-screw extruder under vacuum, then melted at 270° C. and then mixed together in a dynamic mixer so that components A), B) and C) were mixed together homogeneously and in a finely dispersed manner.

The monofilaments were then produced in per se known manner on a monofilament spin/stretch unit. To do this, from a device for the melt-spinning of monofilaments the filament-forming polymer melt was spun off for cooling purposes into a water bath at 20 to 30° C., then stretched 3.5-fold in hot water at 80° C. and in hot air at 150° C. and finally fixed in hot air at 210° C.

Example 6 shows a nylon monofilament with no maleic anhydride modified PE/PP rubber, only of stabilized polyamide 6 ($\eta_{rel}$=4.0) for comparison with the monofilaments according to the invention according to Examples 1 to 5. Production was similar to the spinning process described above.

The results of Examples 1 to 6 are summarized in Table 1.

Abrasion Measuring Method

In the examples the abrasion tests were carried out on the test rods produced from the monofilaments using Messrs Einlehner's abrasion tester AT 2000 in calcium carbonate/water suspension.

Used as wear body was a ceramic strip rotary body comprising 16 circularly arranged round rods of Al-oxide ceramic with surface-ground, screen-touching outer side. The arrangement approximately corresponds to the open and closed surfaces of a flatbox in a paper machine. The material loss of the particular test screen is determined from the difference between abraded and non-abraded screen surface as weight and thickness loss.

TABLE 1

Examples 1 to 6

| Ex. No. | Comp. A Nylon 6 wt. % | Comp. B Maleic anhydride modified PE/PP rubber wt. % | Comp. C Sabilizer wt. % | Dia. mm | Count dtex | Count strength cN/tex | Max. tensile elongation, % | Hot air shrinkage at 150° C., % | Boil shr. % | Mass loss through abrasion, μm | Weight loss of screen sample through abrasion, mg |
|---|---|---|---|---|---|---|---|---|---|---|---|
| 1 | 98.25 | 1.25 | 9.5 | 0.218 | 431 | 34.26 | 54.77 | 5.60 | 9.6 | 66 | 1.9 |
| 2 | 97 | 2.5 | 0.5 | 0.218 | 430 | 34.50 | 58.04 | 5.50 | 8.8 | 62 | 1.9 |
| 3 | 94.5 | 5 | 0.5 | 0.212 | 405 | 32.44 | 55.45 | 5.20 | 8.6 | 57 | 1.6 |
| 4 | 89.5 | 10 | 0.5 | 0.216 | 413 | 28.19 | 53.00 | 5.00 | 8.6 | 53 | 1.3 |
| 5 | 84.5 | 15 | 0.5 | 0.213 | 397 | 25.82 | 56.56 | 4.70 | 8.5 | 47 | 1 |
| 6 | 99.5 | 0 | 0.5 | 0.215 | 420 | 37.02 | 62.26 | 5.80 | 9.2 | 70 | 2 |

Table 2 shows further Examples 7 to 10 in which a hydrolysis-stabilized high-molecular polyethylene terephthalate (PET) with a maleic anhydride modified polyethylene/propylene rubber (EXXELOR VA 1803) and a hydrolysis stabilizer (STABAXOL P100) was used instead of polyamide.

TABLE 2

Examples 7 to 10

| Ex. No. | Comp. A Polyethylene terephthalate, wt. % | Comp. B Maleic anhydride modified PE/PP rubber, wt. % | Comp. C Stabilizer, wt. % | Diameter mm | Count strength cN/tex | Max. tensile elongation, % | Mass loss through abrasion $\mu$m | Weight loss of screen sample through abrasion, wt. % |
|---|---|---|---|---|---|---|---|---|
| 7 | 95.5 | 2.5 | 2 | 0.218 | 35.3 | 33.5 | 80 | 2.5 |
| 8 | 93 | 5 | 2 | 0.218 | 32.4 | 33.1 | 76 | 2.3 |
| 9 | 88 | 10 | 2 | 0.212 | 34.1 | 35.2 | 74 | 1.9 |
| 10 | 98 | 0 | 2 | 0.216 | 32.40 | 37.9 | 90 | 2.9 |

Table 3 reports the properties of technical wire (lawnmower wire) produced from unstabilized copolyamide (nylon 6: nylon 6.6 content=82:18 wt. %) with a maleic anhydride modified polyethylene/polypropylene rubber. In tests under practical conditions the length loss, for example, was determined according to the concrete edge impact test. The length loss decreases with an increasing content of maleic anhydride modified rubber.

TABLE 3

Examples 11 to 14

| Comp. A nylon 66/-18, wt. % | Comp. B Maleic anhydride modified PE/PP rubber, wt. % | Comp. C Stabilizer, wt. % | Diameter, mm | Count tensile force, daN | Count strength, cN/tex | Max. tensile elongation, % | Standard flexural strength N/mm$^2$ | Length loss after concrete edge impact test, cm | Mowing on natural stone in cm |
|---|---|---|---|---|---|---|---|---|---|
| 85 | 15 | 0 | 2.400 | | | | | 7.0 | 9 |
| 80 | 20 | 0 | 2.400 | | | | | 4.0 | 7 |
| 75 | 25 | 0 | 2.392 | 61.9 | 12.70 | 51.60 | 19.33 | 2.0 | 5 |
| 100 | 0 | 0 | 1.987 | 147.0 | 41.8 | 25.3 | 68.3 | Wire breaks off completely | 12.0 |

We claim:

1. Melt-spun monofilaments of nylon or polyester as filament-forming polymers for the manufacture of technical wire, lawnmower wire, or technical textile surface materials comprising a homogeneous blend of a) 99 to 70 wt. % of a nylon or polyester filament-forming polymer, b) from 30 to 1 wt. % of a maleic anhydride modified polyethylene/polypropylene rubber and additionally c) up to 3 wt. %, based on the combinded weight of a)+b), of ageing stabilizers.

2. Monofilaments according to claim 1, wherein the filament-forming polymer is a nylon.

3. Monofilaments according to claim 2, wherein said nylon filament-forming polymer is selected from the group consisting of nylon 6, nylon 6.6, nylon 6.12, nylon 11, nylon 12, copolymers of said nylons, copolymers of the reactants forming said nylons and mixtures thereof.

4. Monofilaments according to claim 2, wherein said nylon filament-forming polymer is selected from the group consisting of nylon 6, nylon 6.6, nylon 6.12, nylon 11, nylon 12, copolymers of said nylons, said copolymers and mixtures thereof.

5. Monofilaments according to claim 1, wherein the content of the rubber b) is from 5 to 20 wt. % and the content of filament-forming polymer a) is from 80 to 95 wt. %.

6. Technical textile materials incorporating the monofilaments according to claim 1.

7. Technical textile materials according to claim 6, wherein said materials are grading fabrics, screen printing fabrics, conveyor belts, and mould screens or press felts for cellulose fibre preparation or paper manufacture.

8. Mould screens or press felts for cellulose fibre preparation and paper manufacturer incorporating the monofilaments according to claim 1.

9. Lawnmower wire comprising monofilaments according to claim 1.

10. Monofilaments according to claim 1, wherein said ageing stabilizers comprise from 0.01 to 3 wt. %.

11. Melt-spun monofilament of a polyethylene terephthalate (PET) or polybutylene terephthalate (PBT) as a filament-forming polymer for the manufacture of technical wire, lawnmower wire, or technical textile surface materials comprising a homogeneous blend of a) 99 to 70 wt. % of a filament-forming polymer, b) from 30 to 1 wt. % of a maleic anhydride modified polyethylene/polypropylene rubber and additionally c) up to 3 wt. %, based on the combined weight of a)+b), of ageing stabilizers.

* * * * *